US006085924A

United States Patent [19]

Henderson

[11] Patent Number: 6,085,924

[45] Date of Patent: Jul. 11, 2000

[54] PLASTIC CONTAINER FOR CARBONATED BEVERAGES

[75] Inventor: John P. Henderson, Kennesaw, Ga.

[73] Assignee: Ball Corporation, Broomfield, Colo.

[21] Appl. No.: 09/158,445

[22] Filed: Sep. 22, 1998

[51] Int. Cl.[7] ..... B65D 1/02; B65D 23/00

[52] U.S. Cl. ..... 215/375; 215/373; 215/377; 220/606

[58] Field of Search ..... 215/371, 373, 215/375, 377; 220/606, 608, 609

[56] References Cited

U.S. PATENT DOCUMENTS

| | | | |
|---|---|---|---|
| D. 267,233 | 12/1982 | Aoki | D9/370 |
| D. 327,845 | 7/1992 | Behm et al. | D9/434 |
| D. 330,330 | 10/1992 | Behm et al. | D9/434 |
| 3,403,804 | 10/1968 | Colombo | 215/31 |
| 3,598,270 | 8/1971 | Adomaitis et al. | 215/1 C |
| 3,727,783 | 4/1973 | Carmichael | 215/1 C |
| 3,759,410 | 9/1973 | Uhlig | 215/1 C |
| 3,871,541 | 3/1975 | Adomaitis | 215/1 C |
| 3,935,955 | 2/1976 | Das | 215/1 C |
| 4,249,667 | 2/1981 | Pocock et al. | 215/1 C |
| 4,254,882 | 3/1981 | Yoshino | 215/1 C |
| 4,267,144 | 5/1981 | Collette et al. | 264/523 |
| 4,294,366 | 10/1981 | Chang | 215/1 C |
| 4,318,489 | 3/1982 | Snyder et al. | 215/1 C |
| 4,335,821 | 6/1982 | Collette et al. | 215/1 C |
| 4,352,435 | 10/1982 | Yoshino | 215/1 C |
| 4,355,728 | 10/1982 | Ota | 215/1 C |
| 4,368,825 | 1/1983 | Motill | 215/1 C |
| 4,620,639 | 11/1986 | Yoshino | 215/1 C |
| 4,785,949 | 11/1988 | Krishnakumar et al. | 215/1 C |
| 4,785,950 | 11/1988 | Miller et al. | 215/1 C |

(List continued on next page.)

FOREIGN PATENT DOCUMENTS

| | | | |
|---|---|---|---|
| 0 225 155 A2 | 6/1987 | European Pat. Off. . | |
| 0 244 128 A2 | 11/1987 | European Pat. Off. . | |
| 19 41 979 | 7/1966 | Germany . | |
| 29 20 122 A1 | 11/1980 | Germany . | |
| 4-44943 | 2/1992 | Japan . | |
| 5-65165 | 3/1993 | Japan . | |
| 585535 | 4/1993 | Japan | 220/608 |
| 5229544 | 9/1993 | Japan | 220/608 |
| 2 067 160 | 7/1981 | United Kingdom . | |
| WO 86/05462 | 9/1986 | WIPO . | |
| WO 92/00880 | 1/1992 | WIPO . | |
| WO 98/28193 | 7/1998 | WIPO . | |

OTHER PUBLICATIONS

Continental Can, Modern Packaging, Clearing the shelves for all plastic soda and beer bottles, Oct. 1973, pp. 22–25. Disclosed anonymously, Research Disclosure, Five Footed Bottle, Mar. 1980, Disclosure No. 19122, pp. 113–114 (translation attached).

*Primary Examiner*—Sue A. Weaver
*Attorney, Agent, or Firm*—Locke Reynolds LLP

[57] ABSTRACT

A blow molded plastic container for carbonated beverages includes an upper mouth-forming portion, a cylindrical sidewall portion and a lower base-forming portion, all of the portions being generally symmetrically situated about a central longitudinal axis. The lower base-forming portion includes a central portion contiguously surrounding the central longitudinal axis and a plurality of circumferentially-spaced, downwardly convex rib segments, each rib segment extending upwardly from the central portion following a hyperbolic profile and expanding circumferentially outwardly to merge with the sidewall. The lower base-forming portion additionally has a plurality of intervening and circumferentially-spaced, convex, hollow foot-forming portions extending downwardly from the circumferentially-spaced, rib segments. Each of the foot-forming portions has a bottom clearance-forming portion adjacent the central portion and a lower outer portion defined by the rotation of a heel radius greater than 0.8 cm about a central point of each foot situated on a contact radius. The rotation of the heel radius is along a mirrored hyperbolic profile having a coefficient of curvature of between about 0.65 and 0.80 so that the bottom of the foot exhibits essentially no incidence of creases and folds common in prior art containers.

30 Claims, 6 Drawing Sheets

U.S. PATENT DOCUMENTS

| | | | |
|---|---|---|---|
| 4,850,493 | 7/1989 | Howard, Jr. | 215/1 C |
| 4,850,494 | 7/1989 | Howard, Jr. | 215/1 C |
| 4,865,206 | 9/1989 | Behm et al. | 215/1 C |
| 4,867,323 | 9/1989 | Powers | 215/1 C |
| 4,978,015 | 12/1990 | Walker | 215/1 C |
| 5,024,339 | 6/1991 | Riemer | 215/1 C |
| 5,024,340 | 6/1991 | Alberghini et al. | 215/1 C |
| 5,064,080 | 11/1991 | Young et al. | 215/1 C |
| 5,072,841 | 12/1991 | Okhai | 215/1 C |
| 5,080,244 | 1/1992 | Yoshino | 215/1 C |
| 5,139,162 | 8/1992 | Young et al. | 215/1 C |
| 5,160,059 | 11/1992 | Collette et al. | 215/1 C |
| 5,205,434 | 4/1993 | Brunson et al. | 220/608 |
| 5,261,543 | 11/1993 | Ugarelli | 215/1 C |
| 5,287,978 | 2/1994 | Young et al. | 215/1 C |
| 5,320,230 | 6/1994 | Hsiung | 215/1 C |
| 5,353,954 | 10/1994 | Steward et al. | 220/608 |
| 5,427,258 | 6/1995 | Krishnakumar et al. | 215/400 |
| 5,454,481 | 10/1995 | Hsu | 220/608 |
| 5,507,402 | 4/1996 | Clark | 215/375 |
| 5,529,196 | 6/1996 | Lane | 215/375 |
| 5,603,423 | 2/1997 | Lynn et al. | 220/606 X |
| 5,664,695 | 9/1997 | Young et al. | 215/375 |
| 5,685,446 | 11/1997 | Young et al. | 215/375 |
| 5,714,111 | 2/1998 | Beck et al. | 264/532 |
| 5,756,018 | 5/1998 | Valyi | 264/40.1 |
| 5,772,056 | 6/1998 | Slat | 215/12.2 |
| 5,785,197 | 7/1998 | Slat | 215/375 |
| 5,803,290 | 9/1998 | Bongiorno | 215/384 |
| 5,858,300 | 1/1999 | Shimizu et al. | 215/371 X |
| 5,906,286 | 5/1999 | Matsuno et al. | 220/608 X |

PLASTIC CONTAINER FOR CARBONATED BEVERAGES

FIELD OF THE INVENTION

This invention relates to plastic containers for fluids under pressure, such as carbonated soft drinks, beer and the like. More particularly, this invention relates to bottoms for plastic bottles for carbonated beverages that can provide a stable container of minimal height having resistance to distention, crazing and stress cracking and immunity to unwanted creases and folds.

BACKGROUND OF THE INVENTION

Plastic containers that can reliably contain carbonated beverages generating internal pressures as high as 100 psi or more, and that can be inexpensively manufactured in attractive shapes, pose technical problems that have received substantial attention.

The spherical shape, which has the greatest ratio of volume to surface area, provides an optimum uniform distribution of wall stresses generated by internal pressures. Thus, the spherical shape achieves the maximum reliable and effective strength for a given wall material thickness. Indeed, internal pressures within non-spherically-shaped containers tend to urge the non-spherically-shaped containers toward a spherical shape. A spherical shape is, however, unacceptable as a commercial beverage container because, among other obvious reasons, a sphere has no stable base, is difficult to handle, and cannot effectively use shelf and storage space of retail and wholesale purveyors and manufacturers.

An extensive variety of cylindrical plastic beverage containers have been designed that can reliably and attractively contain carbonated beverage products. Generally, the commercial containers can be easily handled, can be inexpensively manufactured, and have stability when filled and unfilled. Early designs for cylindrical containers employed the advantages of the spherical shape by employing a hemispherical bottom to which a separate base cup was added to provide stability. Cost considerations have largely replaced such designs with one-piece cylindrical containers having one of two general designs.

One design for commercial containers includes a "champagne" type base including concave, or "domed" evasion-resisting central bottom portions merging with the cylindrical container sidewalls at an annular ring which forms a stable base for the container. Unfortunately, champagne bases require a greater wall thickness in the base portion to resist the distending and everting forces of the internal pressure, particularly during hot summer months. Additionally, stress concentrations at the annular base-forming transition between the concave central bottom portion and cylindrical sidewall make the base portion prone to stress cracking and rupture when the container is dropped. One container using this general champagne base design is disclosed in U.S. Pat. No. 4,249,666.

Another design for commercial containers employs a plurality of feet protruding downward from a generally convex web structure joining the sidewall of the container to a central bottom portion. Many container designs providing footed bottles are in commercial usage. Examples of containers using this design are disclosed in U.S. Pat. Nos. 4,865,206 and 5,353,954. Such containers have most frequently been manufactured from plastic materials such as polyethylene terephthalate (PET) by blow molding a preformed parison into a mold formed in the shape of the container. The biaxial expansion of PET by blow molding imparts strength to the formed PET material. Blow molded PET can provide economically acceptable containers with minimal wall thicknesses. Such containers typically exhibit sufficient strength to contain pressures up to 100 psi and more, and resistance to gas permeation that can deplete the carbonation from the contained beverages. An important performance criterion for footed bottles is the maintenance of the lowest point on the axis of the container above the supporting surface. This is achieved by ensuring that the lowest point on the feet of the container remains below the lowest point on the axis over all pressures that the container is likely to face. However, some containers of the prior art do not satisfy this performance criterion at the pressures commonly developed within filled containers stored at ambient temperatures on hot summer days.

One factor that is frequently over looked in container designs is the propensity of PET to succumb to the deleterious effects of stress cracking and crazing. Stress cracking and crazing is manifest as almost imperceptible streaks in the plastic but ultimately can become complete cracks due to stress and environmental factors. Harmful environmental factors include the exposure to stress cracking agents such as caustics, water, oils and generally any plastic solvent or softening agent. Relatively unstretched portions of a plastic container, such as the central bottom portion, that have low degrees of crystallinity due to the lack of biaxial expansion are particularly susceptible to crazing and stress cracking. The relatively unstretched central portion of the container bottom is generally integrally joined to a plurality of depending feet that are formed with distention-resistant but stress concentrating areas. The composite effect on such areas of stress and strain due to the internal pressure of the container and external environmental factors can lead to crazing, stress cracking and container bottom failure. Efforts to improve the design of such footed containers have frequently led to bottom portions including small radii of curvature, discontinuities, and abrupt transitions between adjoining surfaces that provide additional stress concentration, crazing and stress cracking sites. Additionally, such footed containers frequently exhibit creases and folds in the bottom of the feet detracting from the appearance of the container and possibly even contributing to increasing instability or failure of the container. While many of the known designs are in wide commercial use, none of these container designs is entirely satisfactory in view of cost, manufacturability and reliability.

The desired plastic container for carbonated beverages would exhibit low cost and weight, and would be manufacturable from plastic material by blow molding with minimal plastic material. The desired container would also exhibit a maximal volume with minimal total height in an easily handled diameter. The desired container would also exhibit maximal sidewall height to provide large surface area for product labeling. The desired container would also exhibit excellent stability in both filled and unfilled conditions over a wide range of temperatures and pressures. The desired container would also exhibit a freedom from high stress concentrations, crazing and stress cracking.

SUMMARY OF THE INVENTION

The present invention provides a blow molded plastic container for carbonated beverages that includes an upper mouth-forming portion, a cylindrical sidewall portion and a lower base-forming portion, all of the portions being generally symmetrically situated about a vertical central longitudinal axis. The lower base-forming portion includes a central portion contiguously surrounding the central longitudinal axis and a plurality of circumferentially spaced, downwardly convex rib segments, each rib segment extending upwardly from the central portion following a hyperbolic profile and expanding circumferentially outwardly to merge with the sidewall. The lower base-forming portion additionally has a plurality of intervening and circumferentially spaced, convex, hollow foot-forming portions extending downwardly from the circumferentially spaced, rib segments. Each foot-forming portion has a bottom clearance-forming portion adjacent the central portion and a lower outer portion defined by the rotation of a heel radius greater than 0.8 cm about a central point of each foot situated on the contact or standing radius of the container. The rotation of the heel radius is along a mirrored hyperbolic profile having a coefficient of curvature of between about 0.55 and 0.85, which creates a container that is substantially free from small radii of curvature which might contribute to excessively high stress concentrations, crazing and stress cracking. Containers in accordance with the present invention are manufacturable from plastic material at low cost and weight by blow molding from preformed parisons to form a container having minimal plastic material. Such containers exhibit excellent stability in both filled and unfilled conditions because of their wide footprint and the absence of any folds or creases in the bottom of the feet.

In the present invention, the mirrored hyperbolic profile along which the heel radius is rotated to define the lower outer portion of each foot preferably has a coefficient of curvature of between about 0.67 and 0.76, and more preferably a coefficient of curvature of about 0.7. Each hyperbolic profile is mirrored in a radial plane bisecting each foot so that each foot is symmetric on each side of the bisecting radial plane. The heel radius is preferably greater than 1.0 cm and, in a container having a volume of 2 liters, the heel radius is preferably about 1.3 cm. Each foot-forming portion of a container of the present invention further includes an upper outer portion following the mirrored hyperbolic profile of the lower outer portion and smoothly merging with the adjacent ribs thereby avoiding discontinuities which might contribute to excessively high stress concentrations, which in turn would contribute to crazing and stress cracking in the rib area and folds and creases in the foot bottom.

In the present invention, the bottom clearance-forming portion of each foot generally includes a compound-curved offset formed by opposing radii of curvature that generally curves downwardly from the central portion about a radius of curvature below the base-forming portion before curving about a radius of curvature above the base-forming portion. The opposing radii of curvature in each bottom clearance-forming portion preferably have a radius greater than 3.0 cm and vary from each other by less than 20%, and can be equal in size. Generally, the opposing radii of curvature of said bottom clearance forming portion lie in a range of between 60% and 80% of the outside diameter of the container. This bottom clearance-forming portion taken together with the remaining structure of the bottom ensures excellent stability of the container in both filled and unfilled conditions over a wide range of temperatures and pressures.

In the present invention, each rib segment situated between an adjacent pair of feet conforms to a hyperbolic profile preferably having a coefficient of curvature of between about 0.55 and 0.75, and more preferably about 0.60. In the present invention, each rib segment generally expands circumferentially outwardly by at least 200%, and perhaps by as much as 400%, as it merges with the sidewall. Side margins of each foot-forming portion extend generally radially from the central portion to the contact radius and blend smoothly with the upper outer portion of each foot thereby avoiding any abrupt transition which might contribute to any creases or folds as well as to excessively high stress concentrations leading to crazing and stress cracking.

Further embodiments, features and advantages of the invention will become apparent from the drawings and the following more detailed description of preferred embodiments of the invention.

DETAILED DESCRIPTION OF THE DRAWINGS

FIG. 1. is a side elevation view of a container of the present invention.

DETAILED DESCRIPTION OF ILLUSTRATIVE EMBODIMENTS OF THE INVENTION

Figure 1:
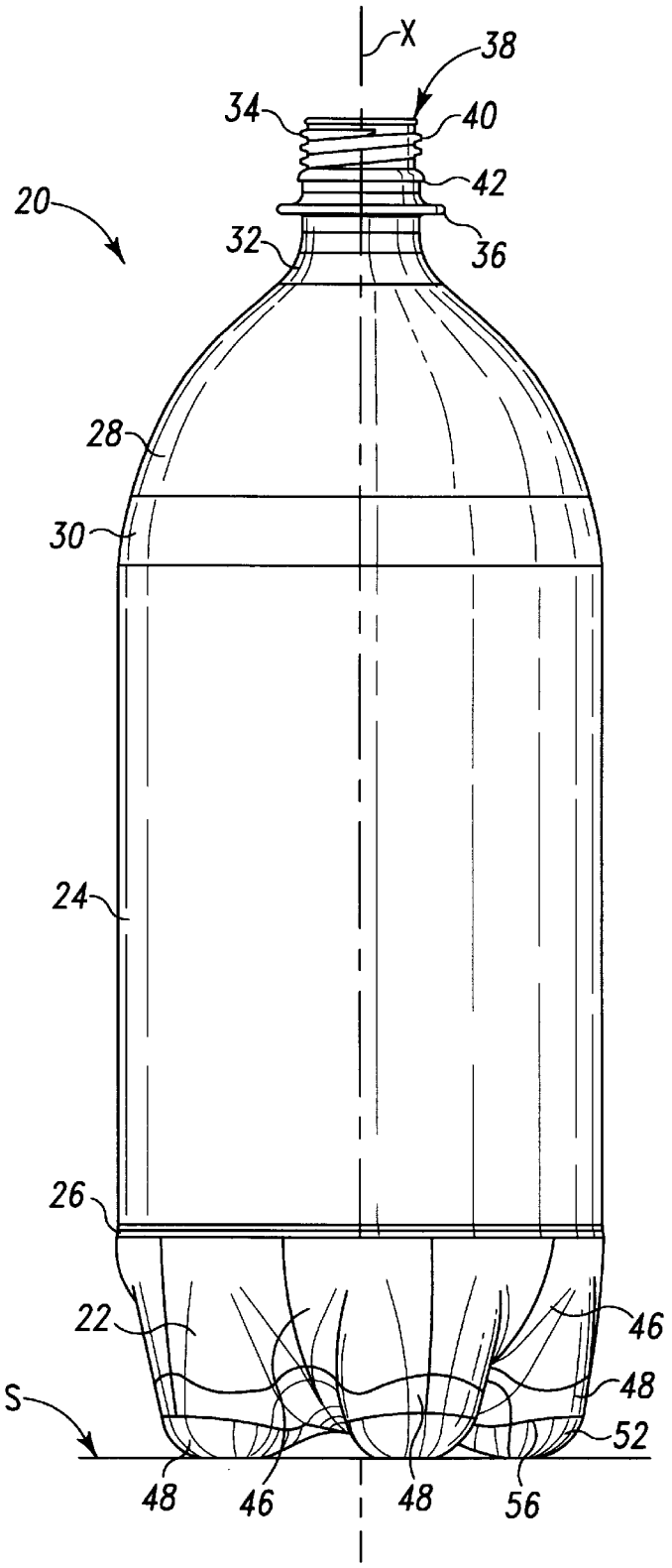

A container 20 according to the present invention is illustrated in FIG. 1 to include a base-forming portion 22 which supports the container 20 in an upright position on a supporting surface S. A cylindrical sidewall portion 24 extends upward from an upper margin 26 of the base forming portion 22. A shoulder portion 28 extends upward from the upper margin 30 of the cylindrical sidewall portion 24, the shoulder portion culminating in a neck forming transition 32. A mouth forming portion 34 at the upper end of the container is supported by the neck forming transition 32 and includes a support ring 36 employed to support the container 20 and precursors thereof during the manufacturing process. The mouth forming portion 34 also includes an upper margin 38 adapted to seal with a closure (not illustrated) which is conventionally secured to the mouth forming portion 34 by threads 40 and a tamper-indicating band 42. The container 20, as a whole, is generally symmetric about a vertical axis X passing through the middle of the container perpendicular to the supporting surface S.

Figure 2:
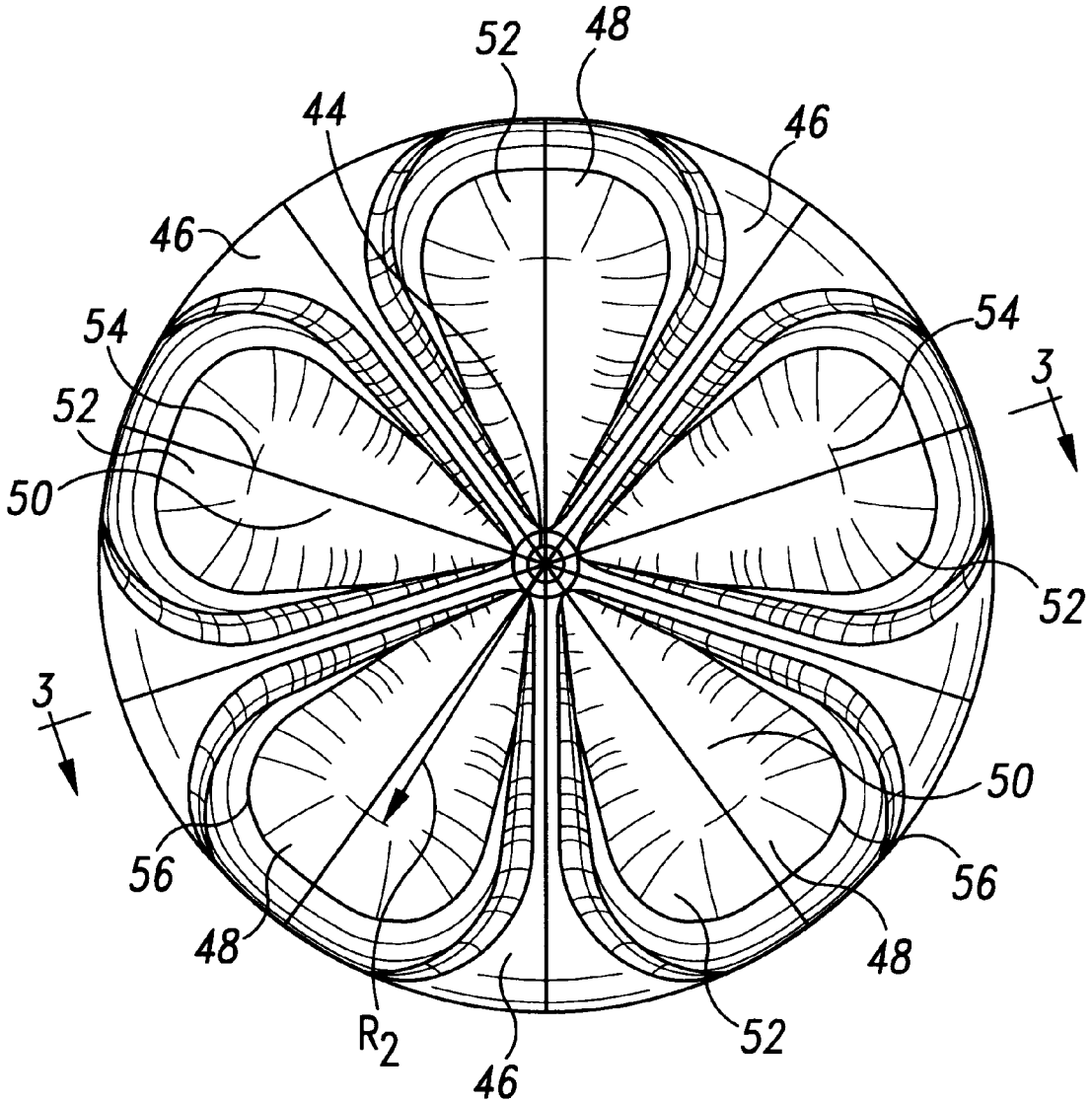
FIG. 2 is a bottom plan view of the container of FIG. 1.

The lower base forming portion 22 is shown in more detail in FIG. 2 to include a central portion 44 contiguously surrounding the central longitudinal axis X. A plurality of circumferentially-spaced, downwardly convex rib segments 46 extend upwardly from the central portion 44 to merge with the sidewall 24 at the sidewall lower margin 26. A plurality of intervening and circumferentially spaced convex hollow foot forming portions 48 extend downwardly from the circumferentially spaced rib segments 46. The structural features of the rib segments 46 and foot forming portions 48 can be better understood from a consideration of FIGS. 3–8.

Figure 3:
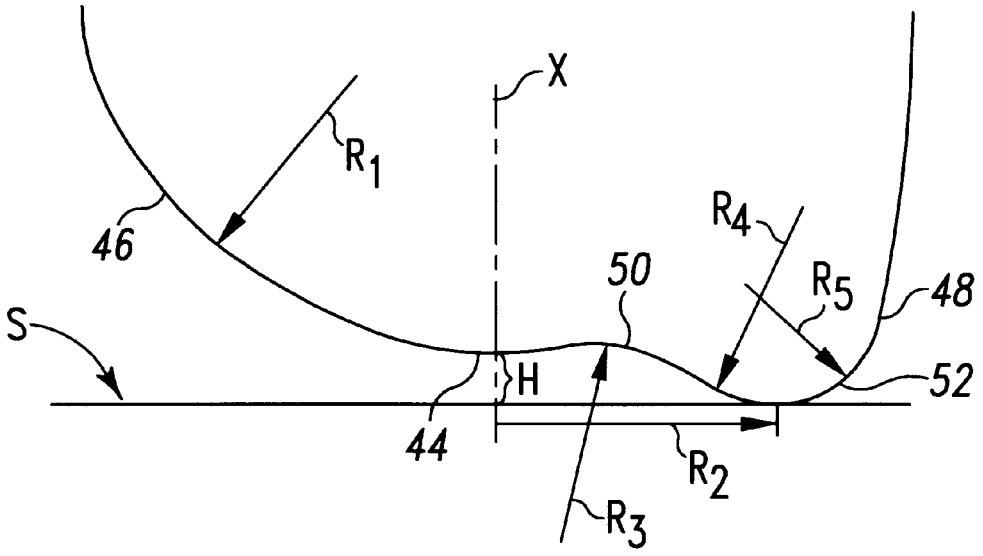
FIG. 3 is a line drawing of the outside surface of the container taken at a plane coplanar with the longitudinal axis of the container and through the central portion of a foot-forming portion, as indicated by sectional line 3—3 from FIG. 2.
Figure 4:
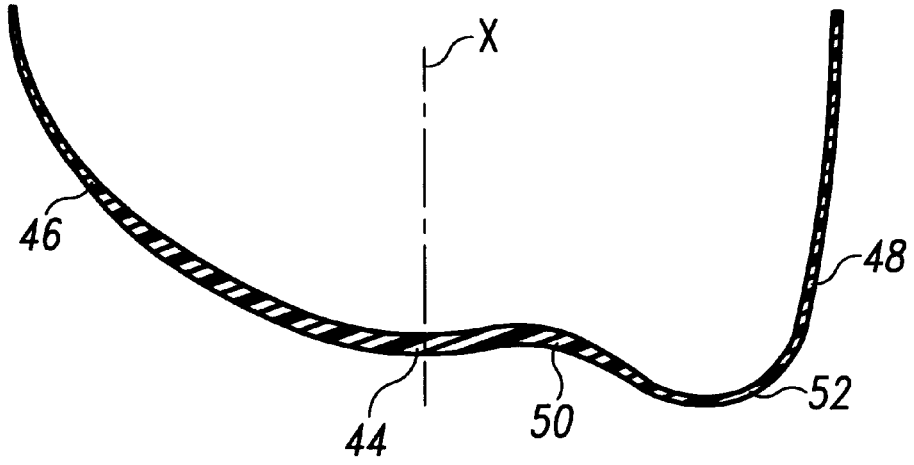
FIG. 4 is a sectional view of the container similar to FIG. 3 showing a typical thickness of the plastic forming the bottom of the container.
Figure 5:
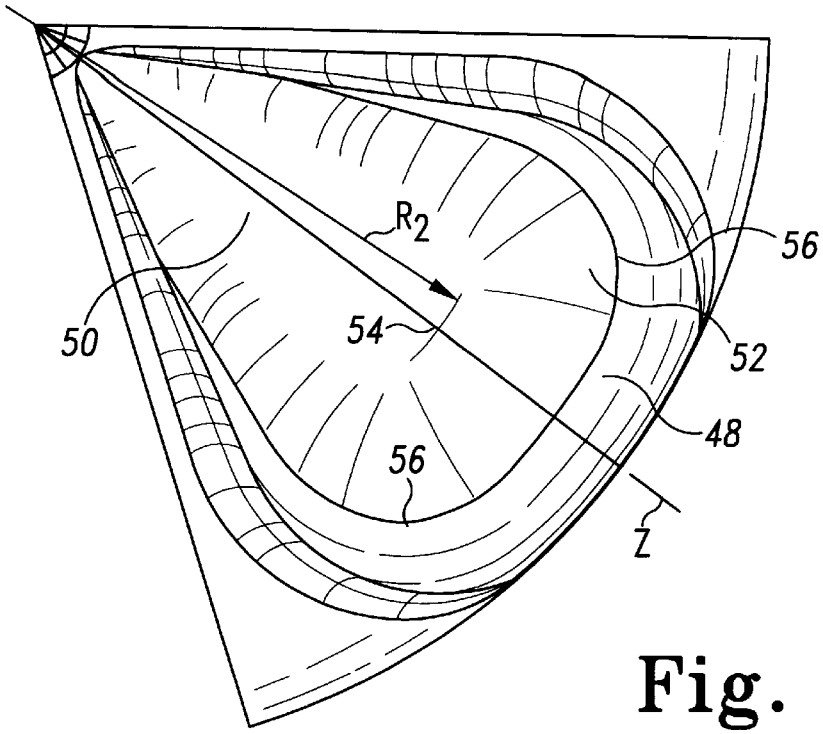
FIG. 5 is bottom view of one foot forming portion of a container of the present invention with the mirrored hyperbolic profile along which the heel radius is rotated to generate the lower outside of the foot emphasized.

The central portion 44 which contiguously surrounds the central longitudinal axis X is shown in FIGS. 3 and 4 to be downwardly convex but may also be formed to be planar or slightly downwardly concave so long as the outer margin of the central portion 44 merges smoothly with both the rib forming portions 46 and the foot forming portions 48.

A radius of R1 of varying length, which follows a hyperbolic profile, defines the rib segment 46. The rib segment expands circumferentially as it extends outwardly particularly beyond the standing radius R2. This circumferential expansion of the rib 46 is seen most dramatically in FIG. 2. The circumferential expansion amounts to an expansion of at least 200%, and preferably at least 400%.

Each of the foot forming portions 48 includes a bottom clearance forming portion 50 which provides a substantial clearance height H between the central portion 44 and the underlying supporting surface S. The bottom clearance-forming portion 50 is defined by a combination of an outside radius R3 and an inside radius R4 forming a compound curve from the central portion 44 to the standing radius R2. The radii forming the compound curve of the bottom clearance forming portion 50 are illustrated to be of approximately equal size but may vary from each other by as much as 10%. The radii R3 and R4 preferably have a radius lying in a range of between 60% and 80% of the outside diameter of the container, which in a typical 2-liter container would mean that the radii would be generally greater than 3.0 cm.

Each foot forming portion 48 further includes a lower outer portion 52 defined by radius R5. The formation of the lower outer portion 52 can best be understood by considering FIGS. 5–7. Considering initially FIG. 5 which shows a bottom plan view of a single foot forming portion 48, it will be noted that the illustrated foot forming portion is mirror symmetric about a radius line Z passing through the axis X of the container. The lowest point on each foot-forming portion is in a small region in the immediate proximity of the intersection 54 of line Z and standing radius R2. The lower outer portion 52 of each foot forming portion 48 extends generally from point 54 outward and upward to a line 56 reproduced in FIG. 6 which defines a hyperbolic profile having a coefficient of curvature generally between 0.65 and 0.80.

Figure 6:
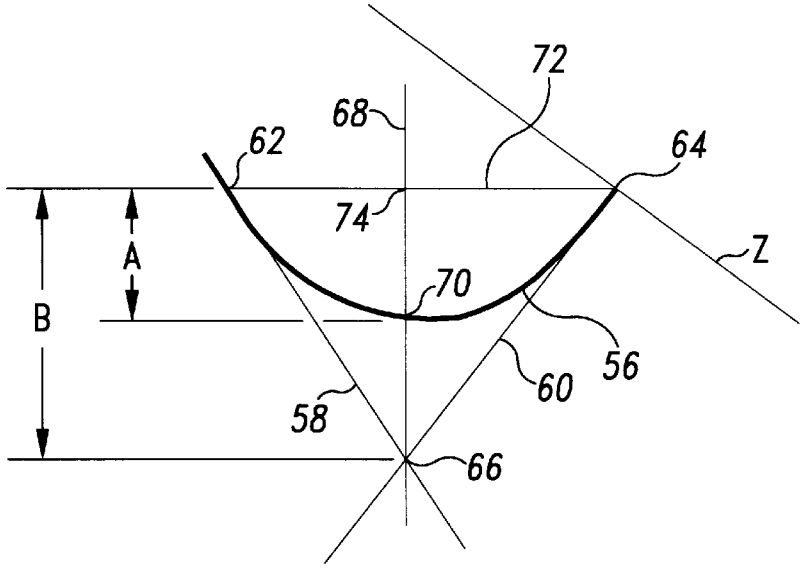
FIG. 6 is a line drawing of the hyperbolic profile taken from FIG. 5 and other points permitting the computation of its coefficient of curvature.

The coefficient of curvature of line 56, or for that matter, any line, is determined by an analysis of three points and two tangent lines as shown in FIG. 6. The two lines 58 and 60 are constructed tangent to the curve 56 at points 62 and 64, respectively. The two tangent lines 58 and 60 intersect at point 66. From point 66, a bisecting line 68 is constructed which passes through line 56 at point 70. A line 72 can be constructed which connects the two points 62 and 64 where the lines 58 and 60 are tangent to the curve 56. Line 68 also intersects line 72 at point 74. It will be seen that the distance A between point 70 and point 74 is a fraction of the distance B between point 74 and point 66. The ratio of these two distances defines the coefficient of curvature of curve 56. Thus the coefficient of curvature C may be expressed as a simple fraction by the equation:

$$C=A/B$$

Additional information concerning coefficients of curvature can be found in standard texts such as *CAD/CAM Theory and Practice* by Ibrahim Zeid, published by McGraw-Hill, Inc.

Figure 7:
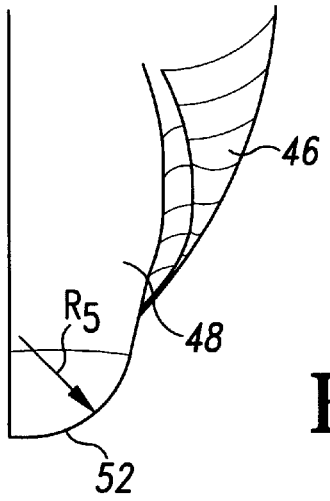
FIG. 7 is an outline of a front elevation view of one half of a foot-forming portion of a container of the present invention.
Figure 8:
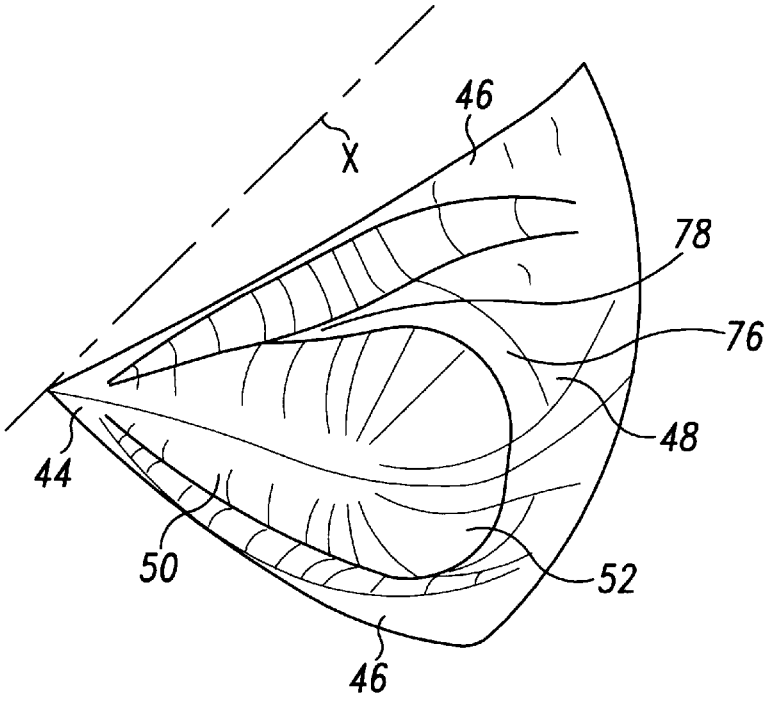
FIG. 8 is a perspective view from the bottom of one foot-forming portion of a container of the present invention.

In the present invention, the lower outer portion 52 of each foot forming portion 48 is defined by the rotation of the heel radius R5 greater than 0.8 cm about a central point or region of each foot situated approximately on the contact radius R2, but along the mirrored hyperbolic profile 56 having a coefficient of curvature between 0.65 and 0.80. Thus the radius R5 shown in FIG. 3 which is in the plane of line Z is the same radius R5 perpendicular to that plane as shown in FIG. 7. In a preferred embodiment, the coefficient of curvature of hyperbolic profile 56 is between 0.67 and 0.76 and even more preferably is at about 0.70. In a preferred embodiment, the heal radius R5 is greater than 1.0 cm and is even more preferably about 1.3 cm. This rotation of this constant heel radius creates a smooth rounded lower outside region 52 to each foot-forming portion 48 as best illustrated in FIG. 8, having essentially no incidence of creases and folds common in prior art containers. Each foot-forming portion 48 further includes an upper outer portion 76 following the mirrored hyperbolic profile 56 and smoothly merging with the adjacent rib segments 46 thereby avoiding any abrupt transition which might contribute to excessively high stress concentrations, crazing and stress cracking. Each foot-forming portion 48 also includes side margins 78 extending from near the central portion 44 to about the standing radius R2 which generally follow radius lines from the central longitudinal axis X which completes the smooth rounded character to each foot-forming portion 48 which creates a container 20 that is substantially free from small radii of curvature which might contribute to excessively high stress concentrations leading to folds, creases, crazing and stress cracking.

Figure 9:
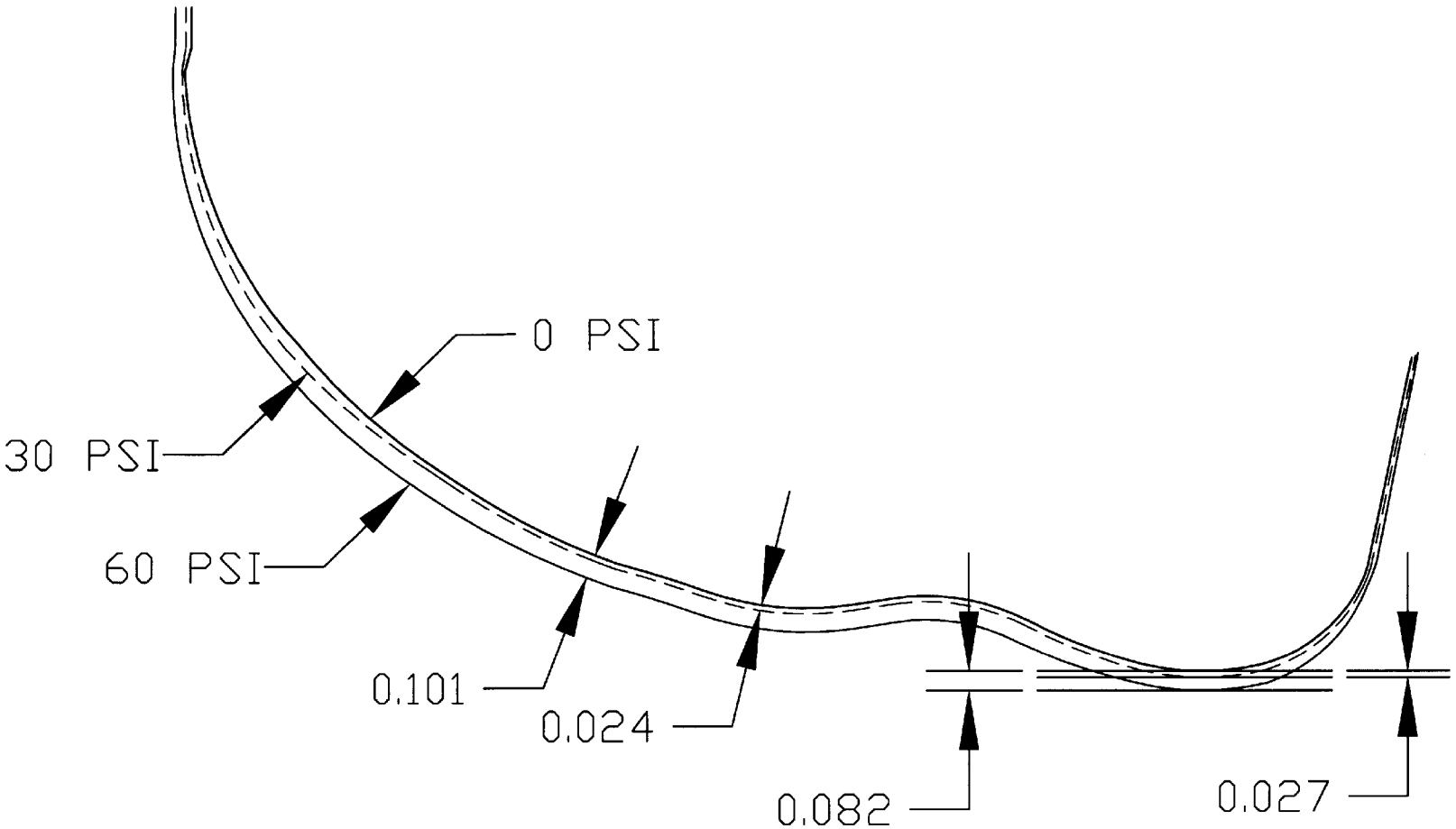
FIG. 9 is a sectional view similar to FIG. 3 showing the change in conformation of the bottom of a container of the present invention as a function of internal pressure.

One feature of a container 20 constructed in accordance with the present invention is the resistance to detrimental deformation of the bottom of the container with increasing pressure on the interior of the container. This is particularly important when the container is to hold material such as carbonated beverages that are likely to exhibit a significant increase in pressure with ambient temperature increase. This is achieved in part by constructing the rib segments 46 to have a hyperbolic profile of between 0.55 and 0.75, and more preferably about 0.60. FIG. 9 shows in solid line the original conformation of a container 20 constructed in accordance with the present invention having a difference between inside and outside pressure of zero psi. As the pressure within the container increases to 30 psi, the container bottom migrates to the position shown by the dashed line. As the pressure increases further to 60 psi, the bottom of the container moves further down to the position shown by the dotted line. It is important to know that with the first pressure difference, the downward movement of the bottom of the foot at the contact radius is larger than the downward movement of the central portion of the container. As the pressure increases further, the downward movement of the central portion of the container is greater than that of the bottom of the foot at the contact radius, but still not so great as to overcome the original vertical offset H achieved by the bottom clearance forming portion of the feet.

While some variations on the illustrated preferred embodiment of the invention has been described above, those skilled in the art will recognize that other embodiments of the invention may be devised within the scope of the following claims.

I claim:

1. A blow molded plastic container for carbonated beverages, comprising an upper mouth-forming portion, a cylindrical sidewall portion and a lower base-forming portion, all of the portions being generally symmetrically situated about a central longitudinal axis, the lower base-forming portion including: a central portion contiguously surrounding the central longitudinal axis, a plurality of circumferentially-spaced, downwardly convex rib segments, each rib segment extending upwardly from the central portion following a hyperbolic profile and expanding circumferentially outwardly to merge with the sidewall, and a plurality of intervening and circumferentially-spaced, convex, hollow foot-forming portions extending downwardly from the circumferentially-spaced, rib segments, each foot-forming portion having a bottom clearance-forming portion, each foot-forming portion further having a lower outer portion defined by the rotation of a heel radius greater than 0.8 cm about a central point of each foot situated on a contact radius along a mirrored hyperbolic profile having a coefficient of curvature of between 0.65 and 0.80.

2. The plastic container of claim 1 wherein a coefficient of curvature of the rib hyperbolic profile is between 0.55 and 0.75.

3. The plastic container of claim 2 wherein the coefficient of curvature of the rib hyperbolic profile is about 0.6.

4. The plastic container of claim 1 wherein each rib segment expands circumferentially outwardly by at least 200% as it merges with the sidewall.

5. The plastic container of claim 4 wherein each rib segment expands circumferentially outwardly by at least 400% as it merges with the sidewall.

6. The plastic container of claim 1 wherein each foot-forming portion heel radius is greater than 1.0 cm.

7. The plastic container of claim 6 wherein each foot-forming portion heel radius is about 1.3 cm.

8. The plastic container of claim 1 wherein the coefficient of curvature of the mirrored hyperbolic profile is between 0.67 and 0.76.

9. The plastic container of claim 8 wherein the coefficient of curvature of the mirrored hyperbolic profile is about 0.70.

10. The plastic container of claim 1 wherein the bottom clearance-forming portion of each foot-forming portion comprises a compound-curved offset formed by approximately equal opposing radii of curvature.

11. The plastic container of claim 10 wherein the compound-curved offset curves downwardly from the central portion about a radius of curvature below the base-forming portion before curving about a radius of curvature above the base-forming portion.

12. The plastic container of claim 10 wherein said approximately equal opposing radii of curvature in each bottom clearance-forming portion have a radius greater than 3.0 cm and vary from each other by less than 10%.

13. The plastic container of claim 12 wherein the opposing radii of curvature in each bottom clearance-forming portion are equal.

14. The plastic container of claim 10 wherein the opposing radii of curvature of said bottom clearance forming portion, lie in a range of between 60% and 80% of the outside diameter of the container.

15. The plastic container of claim 1 wherein each foot-forming portion further includes an upper outer portion following the mirrored hyperbolic profile of the lower outer portion and smoothly merging with the adjacent ribs.

16. The plastic container of claim 1 wherein each foot-forming portion further includes side margins extending from the central portion to the contact radius which follow radius lines from the central longitudinal axis.

17. A plastic container comprising a cylindrical sidewall portion, an upper mouth-forming portion and a lower bottom-forming portion, all portions being situated generally symmetrically about a central longitudinal axis, said bottom-forming portion comprising:

a central portion contiguously surrounding the central longitudinal axis, a plurality of downwardly convex rib segments extending from the central portion to the cylindrical sidewall portion, and a plurality of downwardly convex, hollow foot-forming portions extending radially from the central portion and extending downwardly from the plurality of intervening rib segments to form a plurality of feet supporting the container on a contact radius measured from the central longitudinal axis, each of the downwardly convex rib segments extending upwardly from the central portion following a hyperbolic profile , each rib segment expanding circumferentially outwardly between adjacent foot-forming portions as it merges at its upper end with the cylindrical sidewall.

each of the foot-forming portions comprising a bottom clearance-forming portion between the central portion and the contact radius including a compound-curved offset formed by opposing radii of curvature, each of the opposing radii being greater than 3.0 cm and varying from each other by less than 10%, each foot-forming portion further including a lower outer portion defined by the rotation of a heel radius greater than 0.8 cm about a central point of each foot situated on the contact radius, the rotation being along a mirror-symmetric, hyperbolic profile lying on either side of a radius line from the central longitudinal axis through a mid-line of each foot-forming portion, the mirror-symmetric, hyperbolic profile having a coefficient of curvature of between 0.67 and 0.76.

18. The plastic container of claim 17 wherein a coefficient of curvature of the rib hyperbolic profile is between 0.55 and 0.75.

19. The plastic container of claim 18 wherein the coefficient of curvature of the rib hyperbolic profile is about 0.6.

20. The plastic container of claim 17 wherein each rib segment expands circumferentially outwardly by at least 200% as it merges with the sidewall.

21. The plastic container of claim 20 wherein each rib segment expands circumferentially outwardly by at least 400% as it merges with the sidewall.

22. The plastic container of claim 17 wherein each foot-forming portion heel radius is greater than 1.0 cm.

23. The plastic container of claim 22 wherein each foot-forming portion heel radius is about 1.3 cm.

24. The plastic container of claim 17 wherein the coefficient of curvature of the mirrored hyperbolic profile is about 0.70.

25. The plastic container of claim 17 wherein the compound-curved offset curves downwardly from the central portion about a radius of curvature below the base-forming portion before curving about a radius of curvature above the base-forming portion.

26. The plastic container of claim 17 wherein the opposing radii of curvature in each bottom clearance-forming portion are equal.

27. The plastic container of claim 17 wherein the opposing radii of curvature of said bottom clearance forming portion, lie in a range of between 60% and 80% of the outside diameter of the container.

28. The plastic container of claim 17 wherein each foot-forming portion further includes an upper outer portion following the mirrored hyperbolic profile of the lower outer portion and smoothly merging with the adjacent ribs.

29. The plastic container of claim 17 wherein each foot-forming portion further includes side margins extending from the central portion to the contact radius which follow radius lines from the central longitudinal axis.

30. A plastic container comprising a cylindrical sidewall portion, an upper mouth-forming portion and a lower bottom-forming portion, all portions being situated generally symmetrically about a central longitudinal axis, said bottom-forming portion comprising:

a central portion contiguously surrounding the central longitudinal axis, a plurality of downwardly convex rib segments extending from the central portion to the cylindrical sidewall portion, and a plurality of downwardly convex, hollow foot-forming portions extending radially from the central portion and extending downwardly from the plurality of intervening rib segments to form a plurality of feet supporting the container on a contact radius measured from the central longitudinal axis, each of the downwardly convex rib segments extending upwardly from the central portion following a hyperbolic profile having a coefficient of curvature of between 0.55 and 0.75, each rib segment expanding circumferentially outwardly between adjacent foot-forming portions by at least 200% as it merges at its upper end with the cylindrical sidewall, each of the foot-forming portions comprising a bottom clearance-forming portion between the central portion and the contact radius including a compound-curved offset formed by opposing radii of curvature, each of the opposing radii being greater than 3.0 cm and varying from each other by less than 10%, each foot-forming portion further including a lower outer portion defined by the rotation of a heel radius greater than 0.8 cm about a central point of each foot situated on the contact radius, the rotation being along a mirror-symmetric, hyperbolic profile lying on either side of a radius line from the central longitudinal axis through a mid-line of each foot-forming portion, the mirror-symmetric, hyperbolic profile having a coefficient of curvature of between 0.67 and 0.76, thereby achieving a bottom-forming portion which experiences substantially uniform deformation with increasing pressurization of the plastic container so that the vertical distance between the bottom of the feet and the central portion remains substantially constant.

* * * * *